US005968557A

United States Patent [19]

Weger et al.

[11] Patent Number: 5,968,557

[45] Date of Patent: Oct. 19, 1999

[54] APPARATUS FOR MANUFACTURING SPUN-BONDED WEBS

[75] Inventors: Friedrich Weger; Lüder Gerking, both of Berlin, Germany

[73] Assignee: Karl Fischer Industrieanlagen GmbH, Berlin, Germany

[21] Appl. No.: 08/563,681

[22] Filed: Nov. 28, 1995

[51] Int. Cl.[6] ..... B29C 47/12; B29C 47/34

[52] U.S. Cl. ..... 425/66; 425/72.2; 425/464

[58] Field of Search ..... 264/DIG. 75, 12, 264/210.8; 425/7, 12, 72.2, 66, 464

[56] References Cited

U.S. PATENT DOCUMENTS

| | | | |
|---|---|---|---|
| 2,152,901 | 4/1939 | Manning | 264/12 |
| 2,318,243 | 5/1943 | McClure | 425/7 |
| 2,357,392 | 9/1944 | Francis, Jr. | 264/DIG. 75 |
| 3,265,477 | 8/1966 | McCoppin | 425/7 |
| 3,340,566 | 9/1967 | Woosley et al. | 425/7 |
| 3,685,376 | 8/1972 | Levine et al. | 425/81.1 |
| 3,773,483 | 11/1973 | Schmidt | 264/210.8 |
| 4,058,386 | 11/1977 | Faulkner et al. | 425/7 |
| 4,243,400 | 1/1981 | Ohsato et al. | 425/7 |
| 4,420,441 | 12/1983 | Singer | 264/12 |
| 5,439,364 | 8/1995 | Gerking . | |

FOREIGN PATENT DOCUMENTS

| | | | |
|---|---|---|---|
| 608732 | 11/1960 | Canada | 425/7 |
| 59-47065 | 11/1984 | Japan | 19/299 |

OTHER PUBLICATIONS

International Fiber Journal, "A New System to Produce Spunbonded Nonwovens"; by Dr. F. Weger and Karl Fischer; Industrieanlagen GmbH; Dec. 1994.

*Primary Examiner*—Richard L. Chiesa
*Assistant Examiner*—Robert A. Hopkins
*Attorney, Agent, or Firm*—Marshall & Melhorn

[57] ABSTRACT

The invention relates to a device for manufacturing spun-bonded webs with a nozzle arrangement which spins out warps of yarns. The device according to the invention has a longitudinally-extended duct for generating a gas current which transports the yarns in the duct, and a depositing chamber with an air-permeable deposit belt for deposition of the yarns. The deposit chamber (9) surrounds the conveyor belt (2) in the deposition area of the yarns, and is in the form of a gas-tight casing (9), the width of which is greater than the width of the deposit belt. By means of the casing, a greater degree of vacuum may be used to generate the gas current, and thus the yarns are more intensively drawn. Furthermore, undesirable turbulence of the yarns at the edges of the deposit belt is reduced, and an improvement is achieved in the web structure in these areas.

7 Claims, 3 Drawing Sheets

APPARATUS FOR MANUFACTURING SPUN-BONDED WEBS

Figure 1:
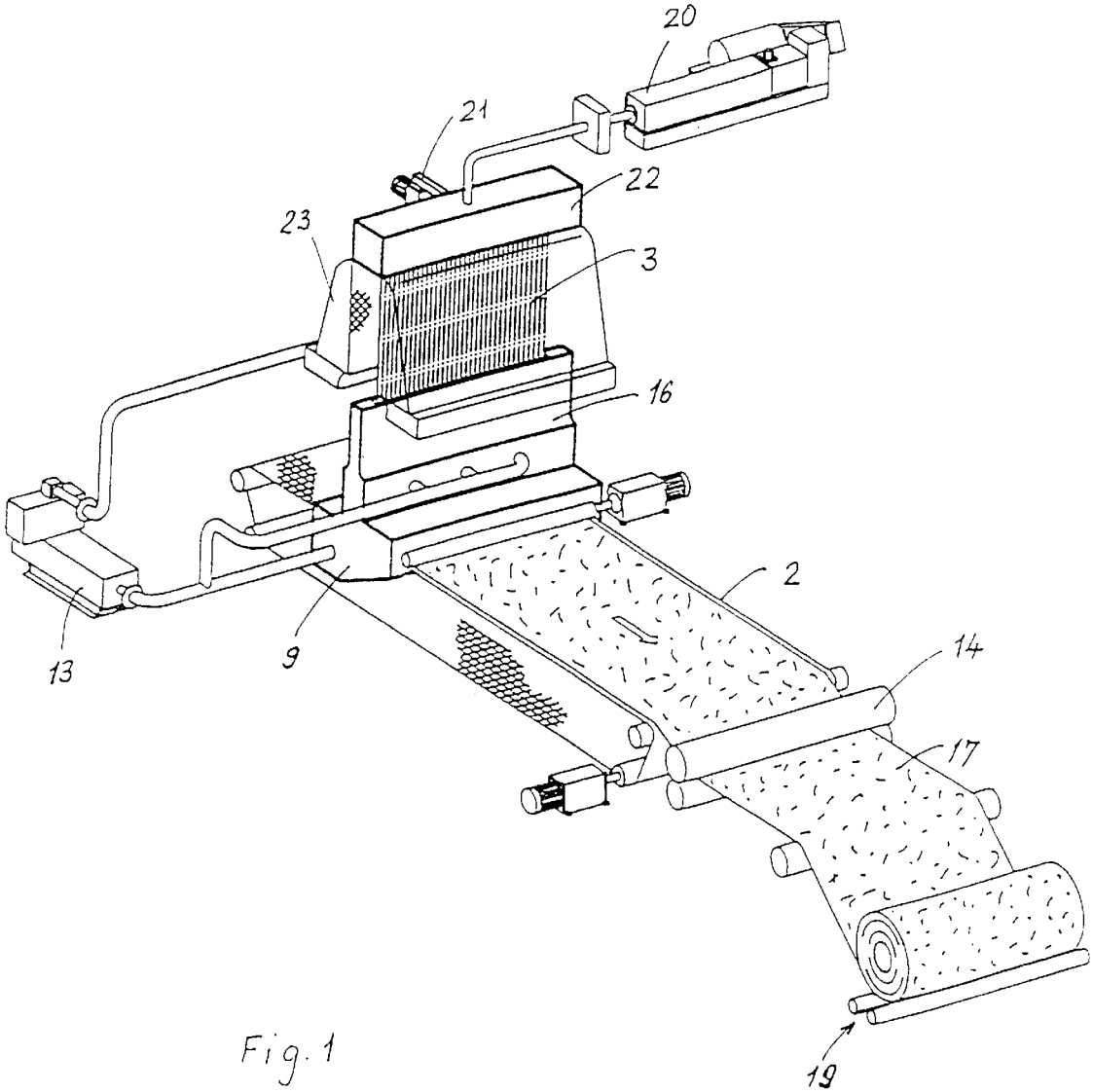

The invention relates to an apparatus for manufacturing spun-bonded webs according to the preamble to the main claim.

There is known from U.S. Pat. No. 5,439,364 a method and an apparatus for transporting and depositing warps of endless yarns which are spun off from a spinning beam or the like, and are transported by means of a gas flow, being introduced in a substantially parallel configuration into a duct with a corresponding cross-section. Connecting with the duct is a deposit chamber which is open to a perforated drum. The drum forms a yarn deposit surface, upon which a spun-bonded web is formed as the drum rotates. Instead of a drum, a deposit belt may be used. The gas flow accompanying the yarns is generated beneath the deposit surface by a suction apparatus.

In another known apparatus for manufacturing spun-bonded webs, a yarn warp or a filament curtain, after being drawn by compressed air or by vacuum, is deposited on a screen belt in the form of a revolving conveyor belt. A deposit chamber is open to the screen belt, or it comprises an upper chamber, above the screen belt, and a lower chamber, beneath the screen belt. The screen belt is conventionally wider than the deposit chamber, or is of the same width as the deposit chamber, the deposit chamber being sealed off laterally from the screen belt by seal strips in the form of frictional seals, brushes, web or the like. The inlet to and outlet from the screen belt are sealed off by seal rollers on the top side and underside of the belt.

The above prior art has the disadvantage that the lateral strips of the spun-bonded web formed on the screen belt or on the perforated drum are extremely irregular as, because leakage flows occur at the edge of the deposit chamber in the vicinity of the seal with the screen belt, due to the pressure differential between a) deposit chamber and environment and b) upper and lower sides of the screen belt, these leakage flows disturb the web deposit in the lateral zones. The pressure in the chamber beneath the screen belt is less than the pressure above the screen belt, and this in turn is less than the ambient pressure. The leakage flow, damaging to the web at the edge, arises from the pressure differential between the pressure, especially in the chamber above the screen belt, and the ambient pressure. Due to the irregular distribution of the yarns of the web in the edge region, there is a large amount of undesirable waste. This is the more intensive as the pressure-differentials increase. Higher yarn speeds require higher air-velocities in the extracting duct, and consequently higher pressure differentials, which can no longer be generated when the leakage flows are large.

The purpose underlying the invention, therefore, is further to develop an apparatus for manufacturing spun-bonded webs, in which the web formation is improved, and a spun-bonded web can be produced which has uniform distribution even in the lateral strips, reducing waste. Furthermore, no air, or as little as possible, is to be sucked in laterally, in order to avoid impairing the uniform deposition of web, and to enable high extraction air-velocities.

This purpose is fulfilled by the characterising features of the main claim, in conjunction with its preamble.

By virtue of the fact that the deposit chamber is in the form of a gas-tight casing surrounding the conveyor belt, i.e. the internal dimension of which is wider than the conveyor belt, the slot-like inlets and outlets of the conveyor belt being sealed by seal rollers extending over the entire width of the conveyor belt, the deposit chamber is laterally totally closed off from the environment in the region of yarn deposit, so that lateral leakage flow is completely avoided.

Moreover, because of the gas-tight seal of the deposit chamber, consolidation of the yarns may be carried out at a substantially higher air velocity, as a lower pressure can be maintained in the deposit chamber and in the drawing duct immediately connected therewith, partial vacuums of up to approximately 0.4 bar compared to the surrounding atmosphere being possible. This entails an increase in the filament speed, which is desirable in order to produce stronger yarns, and in the case of polyester (PFT) is essential, not only in order to obtain better yarn strength, but in order to obtain sufficiently low yarn shrinkage.

Advantageous further developments and improvements are possible because of the measures contained in the secondary claims. A particular advantage is that the conveyor belt is wider than the yarn deposit surface predetermined by the yarn warp, and through which the flow of gas passes, and the lateral areas which project over the yarn deposit surface are gas tight. Disturbance of the yarn deposit due to undesired lateral currents is prevented, so that the quality of the spun-bonded web is further improved.

Figure 2:
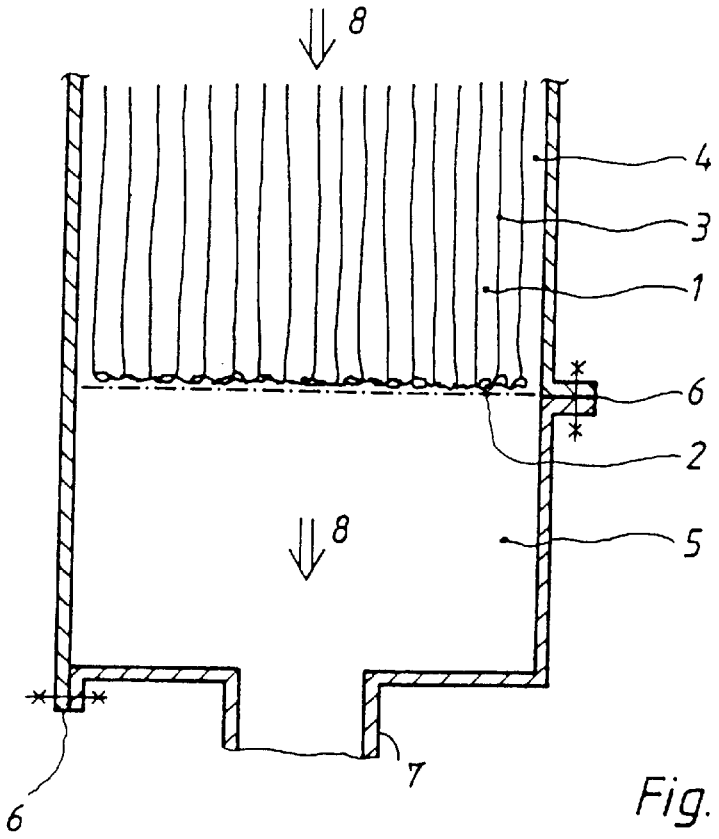
Figure 3:
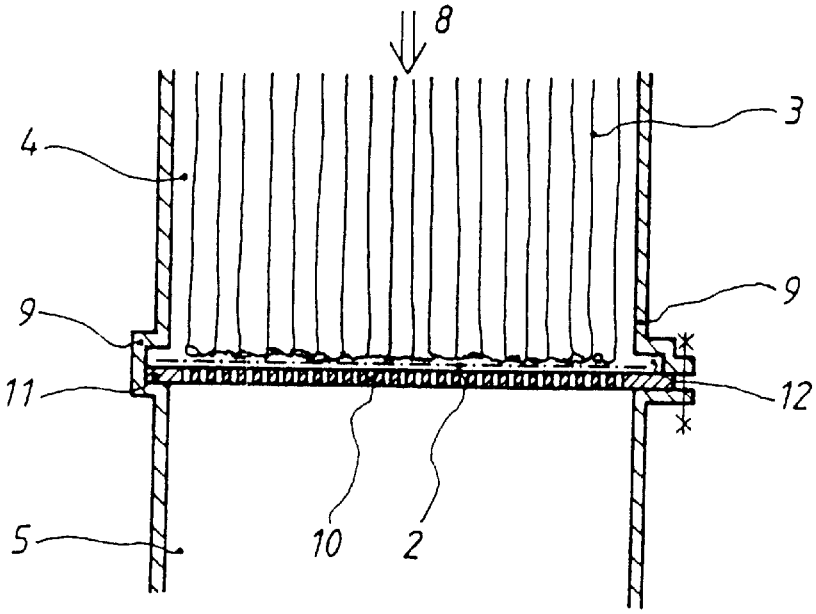
Figure 4:
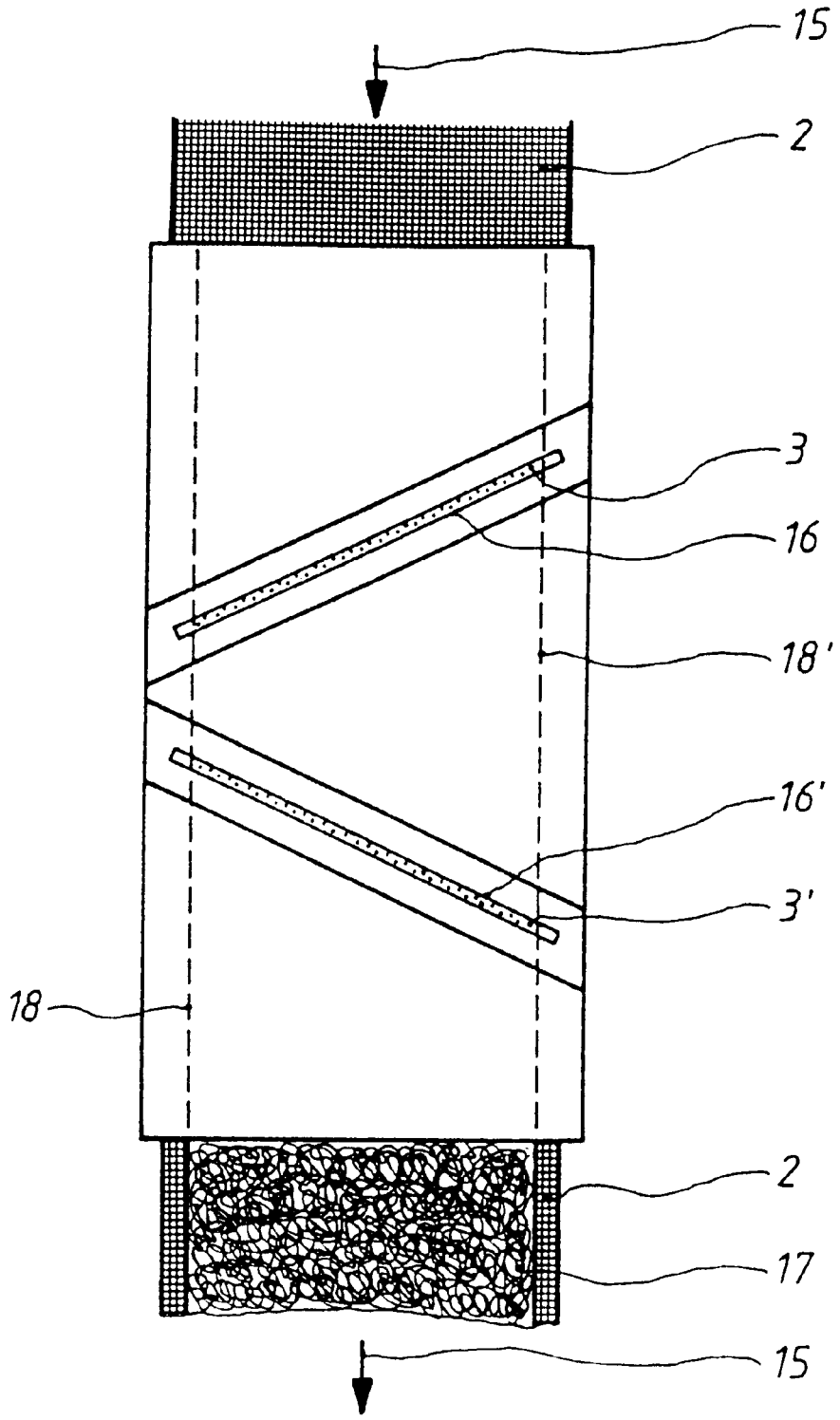

Embodiments of the invention, given by way of example, are shown in the drawings, and will be explained in more detail in the following description. Shown are:

FIG. 1: a perspective view of an apparatus for manufacturing spun-bonded webs;

FIG. 2: a cross-section through a portion of the deposit chamber according to a first embodiment of the invention;

FIG. 3: a partial section through the deposit chamber according to a second embodiment of the invention, and FIG. 4: a plan view of the extraction and deposit portion of a spun-bonded web installation.

FIG. 1 illustrates an apparatus for manufacturing spun-bonded webs, substantially corresponding to U.S. Pat. No. 5,439,364, with a longitudinally-extended conveyor belt 2 and sealed -off casing 9, surrounding the conveyor belt and defining the deposit chamber for the web.

The polymer to be processed is passed from an extruder 20 through a spinning pump 21 in a spinning beam 22 containing spinning nozzles; the said polymer is spun out as a yarn warp. Directed blower devices 23 for directed airflow and cooling are disposed laterally to the emerging yarn warp.

The yarn warp 3 passes into a drafting duct 16, in which it is accelerated by an air current generated by a blower 13; it is decelerated in the lower portion by lateral air extraction and/or cross-sectional expansion, and deposited on the conveyor belt 2. The web 17 formed by the depositing action is consolidated by a heated calendering roller 14, and is wound up by a winding device 19.

The deposit chamber 1 according to the invention, shown diagrammatically in FIG. 2, is used in the apparatus according to FIG. 1, and in a method for manufacturing spun-bonded webs according to the air extraction process. The deposit chamber 1 has passing through it the single air-permeable conveyor belt 2, which may be in the form of a screen belt, perpendicular to the yarn warp 3 or yarn warps emerging from the extraction or drafting duct 16, the yarn warps being deposited on the conveyor belt 2 as matted web 17. The matted web 17 is transported by the conveyor belt 2 out of the deposit chamber 1 and is then consolidated, e.g. by heated calendering rollers 14, and passed to a winding device 19.

In the present case, the deposit chamber 1 comprises an upper casing 4 and a lower casing 5, which are releasably interconnected in a gas-tight manner by a common, continuous flange connection 6. Opening at the top into the upper casing 4 is the drafting duct 16, which is likewise connected thereto in a gas-tight manner. The lower casing 5 has a connector 7 for the extraction device 13, which generates an air current in the direction of arrow 8 in order to draw the yarns spun out by the spinning nozzles (not shown). By means of cross-sectional expansion and/or measures according to U.S. Pat. No. 5,439,364, the yarn warps 3 are decelerated in the deposit chamber 1, in order to enable them to be deposited in a controlled manner on the conveyor belt 2.

The conveyor belt 2, whose width is less than that of the upper and lower casings 4, 5 defining the deposit chamber 1, revolves as an endless loop, entering the deposit chamber 1 through an inlet slot provided in the casing 9, and leaving the deposit chamber 1, together with the matted web 17, through a corresponding outlet slot. The inlet slot and the outlet slot are sealed in a known way by seal rollers which extend over the entire width of the conveyor belt 2. As the conveyor belt 2 is laterally totally covered by the casing 9, the ambient pressure has no influence at that point on the internal pressure in the deposit chamber 1, so that disturbances at the lateral zone of the conveyor belt 2 due to an irregular current from the exterior are avoided. As the conveyor belt 2 is slightly narrower than the overall width of the casing 9, corrections to the belt run are also possible.

In FIG. 2, the deposit casing 9 is shown on the right with upper portion 4 and lower portion 5. It may of course be formed in another way, for example as a single unit, as shown on the left in FIG. 2, or the like; the essential point is that it seals off the deposit chamber 1 laterally from the environment in a gas-tight manner.

FIG. 3 shows another embodiment of the deposit chamber 1. In this case the conveyor belt 2 is wider than the width of the yarn warp 3, and the deposit chamber 9 likewise has a larger cross-section in the region of the conveyor belt 2. In the embodiment shown, the conveyor belt 2 is guided on a perforated support surface 10. Naturally, such a support surface may also be provided in the embodiment according to FIG. 2. In order to avoid disturbance currents to an even greater extent, the lateral areas 11 of the support surface 10 and/or of the conveyor belt 2 are gas-tight, i.e. the extraction current 8 passes through the conveyor belt 2 or the support surface 10, only over a cross-section corresponding to the width of the yarn warp, the current not flowing through the lateral areas 11. The deposit chamber and the extraction duct 16 located above it are slightly wider than the yarn warp due to the border layers forming at the end faces from the extraction duct. There is however a slot 12 between the conveyor belt 2 or support surface 10 and the wall of the deposit chamber 1, so that the conveyor belt does not abrade against the casing.

In the embodiment described above, the direction of travel of the belt 2, which predetermines the arrangement of the deposit chamber 9, is aligned at an angle of 90° to the longitudinal axis of the spinning beam or of the spinning nozzle arrangement. In another embodiment, the casing 9 or the conveyor belt 2 are aligned at an oblique angle to the longitudinal axis of the spinning beam 22, improving the transverse strength of the webs by more intensive transverse deposition. In addition, irregularities which may originate from the spinning nozzle, the directed airflow and other disturbances along the path of travel of the yarn, are compensated for, the yarns at one point being deposited more intensively on adjacent zones. Due to the to-and-fro pivoting movement of the yarns caused by the build-up in front of the belt 2, this is achieved by the component of movement transverse to the direction of travel. This transverse orientation of the yarns in the web 17 may be varied by selecting various angles of the spinning nozzle relative to the direction of travel of the conveyor belt 2.

FIG. 4 shows the suction extraction and deposit portion of one of the spun-bonded web systems from above. The yarn warps 3 and 3' emerge from the spinning nozzles (not shown), which are positioned obliquely to the direction of travel 15 of the conveyor belt 2, enter the suction ducts 16 and 16' and are deposited in the deposit chamber 1 under the upper casing 4 on to the screen belt 2, forming a web 17. The lateral covering of the screen belt 2 extends, in accordance with what was stated in relation to FIG. 3, respectively as far as the dotted line 18 and 18'.

We claim:

1. An apparatus for manufacturing spun-bonded webs with a spinning nozzle arrangement which spins out warps of yarns, with a longitudinally-extended duct for guiding the substantially parallel-oriented yarns, with an apparatus for generating a gas current transporting the yarns in the duct, and with a deposit chamber with an airpermeable conveyor belt for depositing yarns, comprising:

a gas-tight casing (4, 5, 9) defining the deposit chamber (1) and surrounding the conveyor belt (2), with a sealed inlet and outlet slot, the width of the conveyor belt (2) being less than the width of the casing located at points above and below the surface of the conveyor belt (2), and the width of the casing (4, 5, 9) at a point substantially parallel to the surface of the conveyor belt (2) being greater than the width of the casing at points above and below the conveyor belt;

wherein the conveyor belt (2) or a support surface (10) supporting the conveyor belt within the deposit chamber or both are gas impermeable in the lateral areas (11) of the conveyor belt (2), and permit no current flow through the lateral areas of the conveyor belt, the lateral areas of the conveyor belt or the support surface extending substantially outward toward the casing.

2. Apparatus according to claim 1, wherein the duct (16) and the casing (4, 5, 9) are connected together in a gas-tight manner.

3. Apparatus according to claim 1 or 2, wherein the casing (9) has an upper casing (4) and a lower casing (5), which are connected in a gas-tight manner by releasable connections (6) to form a single unit.

4. Apparatus according to one of claims 1 or 2, wherein the conveyor belt (2) is wider than the yarn deposit surface, the yarn deposit surface having the gas current passing through it, but said gas current not flowing through the lateral areas (11) extending over the yarn deposit surface.

5. Apparatus according to one of claims 1 or 2, wherein the casing (9) with the conveyor belt (2) are disposed obliquely relative to the longitudinal axis of the spinning nozzle arrangement and of the duct (16, 16').

6. An apparatus for manufacturing spun-bonded webs with a spinning nozzle arrangement which spins out warps of yarns, with a longitudinally-extended duct for guiding the substantially parallel-oriented yarns, with an apparatus for generating a gas current transporting the yarns in the duct, with a deposit chamber with a conveyor belt for depositing the yarns and optionally with a support surface supporting the conveyor belt within the deposit chamber, comprising:

a gas-tight casing defining the deposit chamber having sealed inlet and outlet slots and through which the conveyor belt travels, the casing having a width in the region of the conveyor belt which is greater than the width of the adjacent regions of the casing, the width of the conveyor belt being less than the width of the casing in the region of the conveyor belt;

wherein the conveyor belt and the optional support surface supporting the conveyor belt, if present, include a gas-permeable central area on which the yarns are deposited, while the lateral areas of the conveyor belt or the optional support surface supporting the conveyor belt or both are gas impermeable, preventing air flow through the lateral areas of the conveyor belt, the lateral areas of the conveyor belt or the support surface extending substantially outward toward the casing.

7. An apparatus for manufacturing spun-bonded webs with a spinning nozzle arrangement which spins out warps of yarns, with a longitudinally-extended duct for guiding the substantially parallel-oriented yarns, with an apparatus for generating a gas current transporting the yarns in the duct, with a deposit chamber with a conveyor belt for depositing the yarns, comprising:

a gas-tight casing defining the deposit chamber having sealed inlet and outlet slots and through which the conveyor belt travels, the casing having a width in the region of the conveyor belt which is greater than the width of the adjacent regions of the casing, the width of the conveyor belt being less than the width of the casing in the region of the conveyor belt;

wherein the conveyor belt includes a gas-permeable central area on which the yarns are deposited, the lateral areas of the conveyor belt extending substantially outward toward the casing and, air flow is prevented through the lateral areas of the conveyor belt, at least while the conveyor belt is located within the deposit chamber.

* * * * *